US010499182B2

(12) United States Patent
Lyren et al.

(10) Patent No.: US 10,499,182 B2
(45) **Date of Patent: *Dec. 3, 2019**

(54) WEARABLE ELECTRONIC DEVICE THAT CORRECTS ERRORS WHERE A USER HEARS BINAURAL SOUND

(71) Applicants: Philip Scott Lyren, Bangkok (TH); Glen A. Norris, Tokyo (JP)

(72) Inventors: Philip Scott Lyren, Bangkok (TH); Glen A. Norris, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/354,183

(22) Filed: Mar. 15, 2019

(65) Prior Publication Data

US 2019/0215639 A1 Jul. 11, 2019

Related U.S. Application Data

(63) Continuation of application No. 16/101,447, filed on Aug. 11, 2018, now Pat. No. 10,313,823, which is a continuation of application No. 15/944,799, filed on Apr. 4, 2018, now Pat. No. 10,051,402, which is a continuation of application No. 15/829,889, filed on Dec. 2, 2017, now Pat. No. 9,955,281.

(51) Int. Cl.
*H04S 7/00* (2006.01)

(52) U.S. Cl.
CPC ..... *H04S 7/304* (2013.01); *H04S 2420/01* (2013.01)

(58) Field of Classification Search
CPC ..... H04S 2420/01; H04S 7/304
USPC ..... 381/309
See application file for complete search history.

(56) References Cited

U.S. PATENT DOCUMENTS

| | | | | |
|---|---|---|---|---|
| 9,584,653 | B1 * | 2/2017 | Lyren | H04M 1/72583 |
| 9,955,281 | B1 * | 4/2018 | Lyren | H04S 7/304 |
| 10,051,402 | B1 * | 8/2018 | Lyren | H04S 7/304 |
| 10,313,823 | B1 * | 6/2019 | Lyren | H04S 7/304 |

* cited by examiner

*Primary Examiner* — Paul Kim

(57) ABSTRACT

A wearable electronic device (WED) corrects errors where a user hears binaural sound. The WED includes a digital signal processor (DSP) that processes sound into binaural sound with HRTFs and head tracking that tracks head movements of the user. The WED plays the binaural sound to the user while the user wears the WED. The WED corrects an error where the user hears the binaural sound.

20 Claims, 4 Drawing Sheets

WEARABLE ELECTRONIC DEVICE THAT CORRECTS ERRORS WHERE A USER HEARS BINAURAL SOUND

BACKGROUND

Three-dimensional (3D) sound localization offers people a wealth of new technological avenues to not merely communicate with each other but also to communicate with electronic devices, software programs, and processes.

As this technology develops, challenges will arise with regard to how sound localization integrates into the modern era. Example embodiments offer solutions to some of these challenges and assist in providing technological advancements in methods and apparatus using 3D sound localization.

SUMMARY

Figure 1:
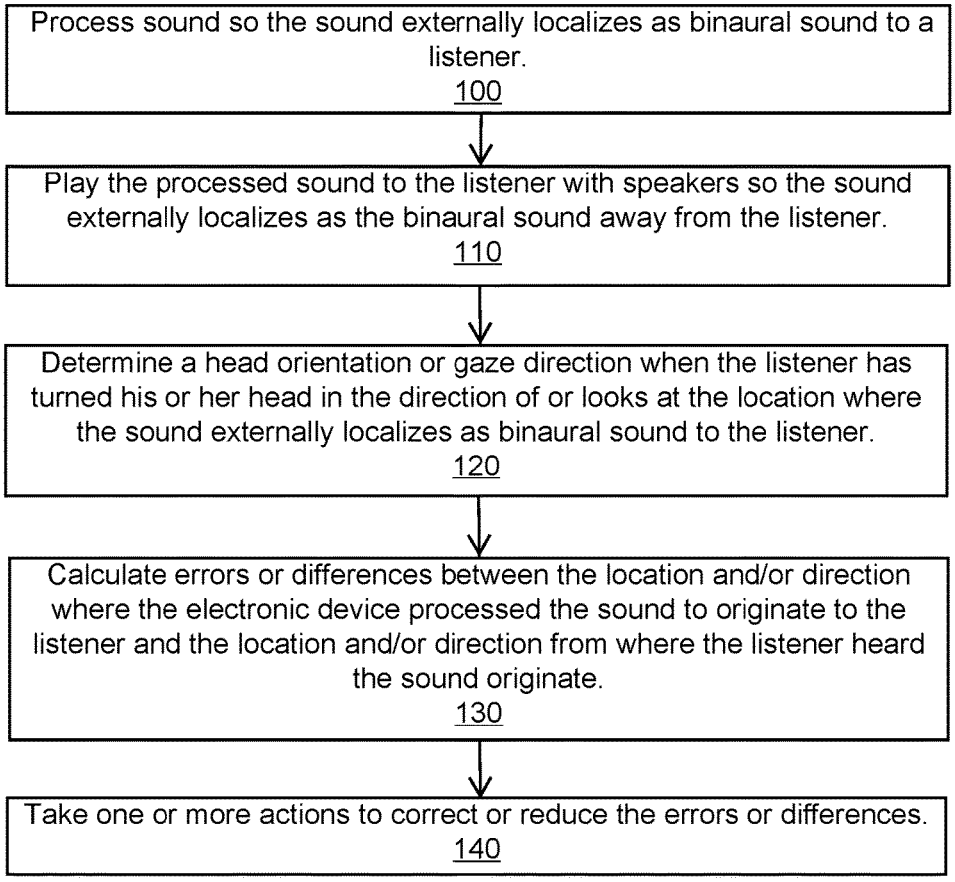
FIG. 1 is a method that corrects errors or differences where a user hears binaural sound in accordance with an example embodiment.

One example embodiment is a portable electronic device or a wearable electronic device that corrects errors where a user hears binaural sound that externally localizes to the user.

Other example embodiments are discussed herein.

DETAILED DESCRIPTION

Telecommunications face many problems and challenges in providing three-dimensional (3D) sound or binaural sound to users. Major problems occur when the location where the listener hears the binaural sound does not align or coincide with the location where the computer intended the listener to hear the binaural sound. These situations cause problems because the computer does not know the location in space where the sound is originating to the listener. For example, the computer cannot accurately move the sound to different locations suggested by the listener or according to program instructions since the computer does not know the origin where the listener hears the sound. As another example, the computer cannot accurately place an image at the location of the sound because the computer does not know where the listener hears the sound. Furthermore, the experience of the listener is be significantly degraded and even ruined. For instance, the listener may hear the sound originating from an unintended location, such as the sound originating behind the listener when the intended location is in front of the listener.

Example embodiments solve these problems and others by providing methods and apparatus that correct errors in externally localizing binaural sound.

Example embodiments include a variety of different methods and apparatus that determine where the user is localizing the binaural sound. Example embodiments determine a location in empty space or at a physical object where the listener hears the sound originating or emanating.

Example embodiments include situations in which the listener knowingly or intentionally assists the computer in determining the origin of the sound and situations in which this determination is made without knowledge or intentional assistance from the listener.

Consider some examples in which the listener knowingly or intentionally assists the computer in determining the origin of the sound.

As one example, the listener points with his or her arm to the location where the sound originates to the listener. The computer captures an image of the arm and determines a location or direction of the origin of the sound based on the captured image. For instance, the arm when extended provides an azimuth and elevation angle of the location where the sound originates to the listener. Alternatively, the computer captures an image of the object where the user is pointing and determines the location from this image (e.g., by executing object recognition and correlating the object to a known location of the user).

As another example, the listener interacts with a user interface and instructs the computer where the sound originates to the listener. For instance, the listener taps on or interacts with a display of a handheld portable electronic device (HPED) to indicate the location, makes a body gesture (hand gesture, head gesture, or eye or gaze gesture) to indicate the location, or provides a verbal instruction or description of the location (e.g., the listener says "on my left side" or "behind me").

As another example, the computer instructs the listener to look at or face the origin of the sound that the computer is currently playing to the listener. The computer also plays multiple sounds at different locations around the head of the listener and track the head movements as the listener looks at each of the different locations. For example, the computer plays a tone that externally localizes to the listener and instructs the listener to turn his or her head in a direction of where the listener hears the tone.

As another example, the computer projects a grid, polar plane, or hemisphere in front of or around the user in order to elicit feedback from the user as to where the user localizes one or more sounds. For example, a user wearing a head mounted display (HMD) sees a virtual vertical plane in virtual reality (VR) two meters in front of and parallel to his or her face. The virtual plane is illustrated with a grid that is marked off in increments of one foot and labeled such that the user indicates to the computer a horizontal and vertical distance between the externalization of the sound and the forward-facing direction of his or her head (e.g., a voice recognition interface parses the coordinates (B,5) when a user states: "I hear the bell at B, 5."). Alternatively, the computer projects an augmented reality (AR) image around a user wearing smart glasses such that the user sees himself or herself as inside a center of a sphere with a radius of 1.5 meters. The surface of the sphere is demarked with vertical lines at each five degrees of azimuth and arcs or lines at each ten degrees of elevation. The lines are labeled such that user indicates to the computer a measure of azimuth and elevation where the user perceives the externalizing sound. For example, elevation lines are illustrated in different colors and vertical lines are labeled with numbers such that a user indicates a particular azimuth and elevation of a perceived sound by indicating to the computer, "twenty-five, green."

Consider some examples in which the listener does not knowingly or intentionally assist the computer in determining the origin of the sound.

The inventors found that when a listener hears binaural sound provided with a computer, the listener will often initially look to the location where the sound originates to the listener. This fact is notably true when the sound originates in a location that is proximate to the listener, such as within several meters from the head of the listener. Sounds that are closer to the listener work better to cause the listener to look in the direction of the origination of the sound. For example, sounds that originate within two meters of the listener work better than sounds that originate farther away, such as sounds that originate three meters away, four meters away, etc. As the origin of the sound gets farther away from the listener, the listener is less likely to look to the actual direction or location where the sound originates. Listeners were also more likely to face the localization when the sound was a voice, and when there was a contrast in volume between the sound and other ambient sound.

One example embodiment processes sounds so they originate approximately one meter to two meters away from the head of the listener. For example, the sounds originate within a range of about 1.0 meters-2.0 m away from the head of the listener work well to cause the listener to move his or her head and/or eyes toward the origin of the sound. Though, as noted, example embodiments include other distances as well.

The inventors have also found that different types of sounds work better than others in causing the listener to look at the location of the origin of the binaural sound that is provided from the computer. The inventors found, for example, that a listener will tend to look in the direction of the sound if the sound is a voice of a human as opposed to other sounds, such as white noise or background noise. When the listener hears the voice, the listener will initially look at the location from where the voice originates.

Other types of sounds also work well in causing the listener to look at the direction or location of the origin of the sound. For example, the ringing sound of a phone or other sound instructing the listener of an incoming telephone call typically cause the listener to look at the origin of the sound.

The head movement and/or eye movement of the listener thus provides important information as to the location where the sound originates to the listener. One or more example embodiments track or determine head and/or eye movement and use this information to determine the location where the listener hears the binaural sound being provided to the listener. As noted, one or more example embodiments also determine the location of an origin of binaural sound without using information from head and/or eye movement.

Consider an example in which a listener wears a portable electronic device (PED) or wears a wearable electronic device (WED) that provides binaural sound to the listener through speakers located in or at the ears of the listener. The PED or WED includes head tracking to track head movement of the listener. A processor (in the PED or WED or in communication with the PED or WED) processes or convolves sound with one or more head-related transfer functions (HRTFs) so the sound externally localizes as binaural sound to the listener (e.g., the sound localizes to a sound localization point (SLP) that is in empty space 1-2 meters away from the head of the listener). For instance, the HRTFs have a spherical coordinate location of (r, θ, ϕ), where r is a distance to a source of sound, θ is an azimuth angle to the source of sound, and ϕ is an elevation angle to the source of sound.

In this example, the PED or WED knows the coordinates (r, θ, ϕ) of the HRTFs but does not know for certain that the listener will externally localize the sound to these coordinates. The listener may externally localize the sound to another location or not externally localize the sound at all. For example, the set of HRTFs were measured from the head of another person and not the listener, or the HRTFs were measured specifically for the listener but the listener experienced an injury that altered the localization of the listener. So, when the PED or WED plays a sound processed with these HRTFs to the listener, the PED or WED tracks head movements of the listener to determine where the listener looks. As explained herein, the direction or location where the listener looks provides an indication as to the origin of the sound to the listener and provides information that confirms whether the HRTFs are appropriately selected to externally localize sound to the listener.

In this example, when the listener looks toward the origin of the sound, the PED or WED executes head tracking to track head movement in a horizontal direction (yaw movement) and in a vertical direction or medial plane (pitch movement). Based on tracking yaw and pitch head movements, the PED or WED calculates a coordinate location where the listener hears an origin of the sound (e.g., when the listener turns his or her head to face the origin of the sound or moves his or her eyes in the direction of the origin of the sound). The PED or WED then calculates a difference between (1) the coordinate location in the focus of the user as the user looks at the origin of the externally localized binaural sound to (2) the coordinate location of the HRTFs that processed the sound before the user looked toward the sound. This difference represents an error between the location where the computer (here, PED or WED) processed the sound to originate to the listener and the location where the sound actually originated to the listener. The PED or WED then corrects or reduces the error (e.g., if the error meets a predetermined threshold value) or takes no action (e.g., ignores the error since the error is within an acceptable range).

In an example embodiment, an electronic device tracks a head orientation and/or eye movement of the listener. When the sound plays to the listener and the listener reacts by facing toward and/or looking toward the localization, the electronic device determines the direction or location where the listener is facing and/or looking relative to the facing direction of the head of the listener at time of the localization of the sound that was played. For example, the sound plays; the listener localizes the sound; and the listener reacts to the localization by turning to face and/or looking toward the localization perceived by the listener. The electronic device tracks changes in location, changes in azimuth or yaw direction, and/or changes in elevation or pitch direction. These changes in facing and/or looking direction indicate a location where the listener heard the sound that produced the reaction of the listener (e.g., the listener turns his or her head toward the location of the sound and/or the listener moves his or her eyes or gaze toward the location of the sound). The electronic device compares this location with a coordinate location of HRTFs that processed or are processing the sound. This comparison reveals a difference or an error between the two locations.

Both a change in head orientation and a gaze angle can be considered together. Consider an example where a single half-second beep is convolved to −55° azimuth. A user is startled, turns his or her head −20°, and gazes left −30°. The electronic device measuring the head orientation and gaze angle calculates that the user is then focused at −50° azimuth. The electronic device also computes the error between the angle of the focus of the user and the azimuth angle of the HRTF used to convolve the sound before the user moved is 5°.

FIG. 1 is a method that corrects errors or differences where a user hears binaural sound in accordance with an example embodiment.

Block 100 states process sound so the sound externally localizes as binaural sound to a listener.

For example, a processor processes the sound with one or more of head-related transfer functions (HRTFs), head-related impulse responses (HRIRs), room impulse responses (RIRs), room transfer functions (RTFs), binaural room impulse responses (BRIRs), binaural room transfer functions (BRTFS), interaural time delays (ITDs), interaural level differences (ITDs), and a sound impulse response.

Sound includes, but is not limited to, one or more of stereo sound, mono sound, binaural sound, computer-generated sound, sound captured with microphones, and other sound. Furthermore, sound includes different types including, but not limited to, music, background sound or background noise, human voice, computer-generated voice, and other naturally occurring or computer-generated sound.

Example embodiments include different types of electronic devices and/or software programs that provide the sound to the listener. These example embodiments include, but are not limited to, providing sound or voice to one or more listeners that are: engaged in a telephone call, located in an automobile (e.g., a self-driving car), playing a software game (e.g., an AR or VR software game), listening to music with virtual speakers in a room or on a wall, speaking to or with an intelligent user agent (IUA) or intelligent personal assistant (IPA), meeting in an AR or VR chat room or chat space, etc.

One or more processors, such as a digital signal processor (DSP), processes or convolves the sound. Furthermore, the processor or sound hardware processing or convolving the sound can be located in one or more electronic devices or computers including, but not limited to, headphones, smartphones, tablet computers, electronic speakers, head mounted displays (HMDs), optical head mounted displays (OHMDs), electronic glasses (e.g., glasses that provide augmented reality (AR)), servers, portable electronic devices (PEDs), handheld portable electronic devices (HPEDs), wearable electronic devices (WEDs), and other portable and non-portable electronic devices.

For example, the DSP processes stereo sound or mono sound with a process known as binaural synthesis or binaural processing to provide the sound with sound localization cues (ILD, ITD, and/or HRTFs) so the listener externally localizes the sound as binaural sound or 3D sound.

HRTFs can be obtained from actual measurements (e.g., measuring HRIRs and/or BRIRs on a dummy head or human head) or from computational modeling.

An example embodiment models the HRTFs with one or more filters, such as a digital filter, a finite impulse response (FIR) filter, an infinite impulse response (IIR) filter, etc. Further, an ITD can be modeled as a separate delay line.

Block 110 states play the processed sound to the listener with speakers so the sound externally localizes as the binaural sound away from the listener.

The speakers are in or on an electronic device that the listener wears, such as headphones, HMD, electronic glasses, smartphone, or another WED, PED, or HPED. Alternatively, the speakers are not with or worn on the listener, such as being two or more separate speakers that provide binaural sound to a sweet spot using cross-talk cancellation.

The sound externally localizes away from the head of the listener in empty space or occupied space. For example, the sound externally localizes proximate or near the listener, such as localizing within a few meters of the listener. For instance, the sound localization point (SLP) where the listener localizes the sound is stationary or fixed in space (e.g., fixed in space with respect to the user, fixed in space with respect to an object in a room, fixed in space with respect to an electronic device, fixed in space with respect to another object or person).

Block 120 states determine a head orientation or gaze direction when the listener has turned his or her head in the direction of or looks at the location where the sound externally localizes as binaural sound to the listener.

The electronic device includes head tracking that tracks or measures head movements of the listener while the listener hears the sound. When the sound plays to the listener, the head tracking determines, measures, or records the head movement or head orientation of the listener.

The electronic device calculates and/or stores the head orientations and/or head movements in a coordinate system, such as a Cartesian coordinate system, polar coordinate system, spherical coordinate system, or other type of coordinate system. For instance, the coordinate system includes an amount of head rotation about (e.g., yaw, pitch, roll) and head movement along (e.g., (x,y,z)) one or more axes. Further, an example embodiment executes to Euler's Rotation Theorem to generate axis-angle rotations or rotations about an axis through an origin.

By way of example, head tracking includes one or more of an accelerometer, a gyroscope, a magnetometer, inertial sensor, MEMs sensor, video tracking, optical tracking (e.g., using one or more upside-down cameras), etc. For instance, head tracking also includes eye tracking and/or face tracking or facial feature tracking.

Head tracking can also include positional tracking that determines a position, location, and/or orientation of electronic devices (e.g., wearable electronic devices such as HMDs), controllers, chips, sensors, and people in Euclidean space. Positional tracking measures and records movement and rotation (e.g., one or more of yaw, pitch, and roll). Positional tracking can execute various different methods and apparatus. As one example, optical tracking uses inside-out tracking or outside-in tracking. As another example, positional tracking executes with one or more active or passive markers. For instance, markers are attached to a target, and one or more cameras detect the markers and extract positional information. As another example, markerless tracking takes an image of the object, compares the image with a known 3D model, and determines positional change based on the comparison. As another example, accelerometers, gyroscope, and MEMs devices track one or more of pitch, yaw, and roll. Other examples of positional tracking include sensor fusion, acoustic tracking, and magnetic tracking.

Block 130 states calculate errors or differences between the location and/or direction where the electronic device processed the sound to originate to the listener and the location and/or direction from where the listener heard the sound originate.

The location and/or direction where the electronic device processed the sound to originate and the location and/or direction where the listener actually heard the sound originating may not match or align. They are different, and this difference represents an error.

For example, an example embodiment stores a first direction that the head of the user is facing while hearing a sound convolved to a location. The example embodiment stores a second facing direction of the head of the user and/or a change in the facing direction relative to the first direction after the user reacts to the convolved sound. The example embodiment compares the second direction to a coordinate location of a pair of the HRTFs that convolved the sound to the user while the user faced the first direction. This comparison reveals a difference or error between these two directions.

Consider an example in which a wearable electronic device (WED) tracks or knows the location of objects (e.g., a sofa and a chair at different locations in a room with a user). For example, locations of objects are known based on reading RFID tags, object recognition, signal exchange between the WED and an electronic device in the object, or sensors in an Internet of Things (IoT) environment. Based on a current head orientation of the user, the WED selects an HRTF pair and convolves sound so the sound originates from the location of the sofa. When the user hears the sound, he or she looks at the location of the chair, not the sofa, since the sound appears to originate from the location of the chair. Since the position of the chair and the sofa are known with respect to the user, the WED calculates an error between where the WED processed the sound to originate and where the user actually heard the sound originate.

Block 140 states take one or more actions to correct or reduce the errors or differences.

One or more electronic devices execute an action to correct or reduce the errors. By way of example, this action includes one or more of correcting the error, reducing the error, compensating for the error, changing HRTFs processing the sound, informing the listener of the error, moving the sound to another external location proximate to the listener, moving the sound to internally localize to the listener (e.g., providing the sound as mono sound or stereo sound instead of binaural sound), changing or adjusting an interaural time difference (ITD) of the sound being provided to the listener, changing or adjusting an interaural level difference (ILD) of the sound being provided to the listener, providing the listener with an audio or visual warning, moving an image being displayed to the listener (e.g., moving an image to from $(\theta, \phi)$ to a $(\theta', \phi')$), adjusting or changing the coordinate locations where the computer calculates the SLP to be for the listener, or taking another action.

In some instances, the electronic device ignores the error or does not take an action in response to determining or calculating the error. For example, the error may be at or below a minimum threshold and hence does not require correction.

Consider an example embodiment in which a wearable electronic device (e.g., headphones, HMD, electronic glasses, a smartphone being worn, etc.) corrects errors or differences where a first user hears a voice in binaural sound of a second user during a telephone call between the first user and the second user. The wearable electronic device includes a processor or digital signal processor (DSP), speakers (at least one for each ear), head tracking, and a wireless transmitter/receiver. During the telephone call, the processor or DSP processes the voice of the second user with head-related transfer functions (HRTFs) having coordinates $(\theta1, \phi1)$, where $\theta1$ is an azimuth angle and $\phi1$ is an elevation angle. Before the user reacts to the sound convolved to the user to $(\theta1, \phi1)$ the electronic device captures a first orientation of the head of the user and defines the orientation as 0° yaw and 0° pitch (e.g., (0°, 0°)).

The speakers play the voice of the second user processed with the HRTFs. During the call, while the first user wears the wearable electronic device, the head tracking measures or tracks head movements or changes in head orientations of the first user. For example, continuing the example above, the first user moves his or her head from a first orientation (0°, 0°) toward a second direction or to a second orientation $(\theta2, \phi2)$, and the head tracking measures or tracks these changes to head orientation and/or head movement. The head of the first user is in the second orientation $(\theta2, \phi2)$ while the first user looks toward the sound localization point (SLP) where the voice of the second user externally localized as binaural sound to the first user when the voice of the second user was processed with the HRTFs and while the head of the first user was in the first orientation.

In this example embodiment, the wearable electronic device (alone or in conjunction with another electronic device) calculates an error of $(|\theta1-2|, |\phi1-\phi2|)$. This error represents a difference between the coordinates $(\theta1, \phi1)$ of the HRTFs that processed the voice of the second user before the reaction of the first user and the coordinates $(\theta2, \phi2)$ of the head orientation while the first user looks at the SLP where the voice of the second user externally localized as binaural sound to the first user. When a difference exists, the wearable electronic device changes the HRTFs processing the voice of the second user to reduce or to eliminate the error of $(|\theta1-2|, |\phi1-\phi2)$.

For example, the processor calculates the difference between (1) the coordinates $(\theta1, \phi1)$ of the HRTFs that processed the voice of the second user while the head of the first user faced the first direction and (2) the coordinates $(\theta2, \phi2)$ of the second direction while the face of the first user pointed in the direction of the SLP where the voice of the second user externally localized as binaural sound to the first user. The processor then addresses the error, such as correcting the error, reducing the error, storing or recording the error, transmitting the error, etc.

Addressing the error or difference can be based on an occurrence of an event. For example, change the HRTFs, ITDs, or ILDs when the difference meets or exceeds a predetermined value. For instance, change or alter the HRTFs processing the voice of the second user in response to calculating that the error of $(|\theta1-\theta2)$ and/or $(|\phi1-\phi2|)$ is greater than, equal to, or less than a threshold value. For instance, the threshold value is five degrees (5°), ten degrees (10°), fifteen degrees (15°), or twenty degrees (20°).

The process of attempting to correct or to reduce the error can be a single event or an iterative process. For example, the wearable electronic device (or an electronic device in communication with the wearable electronic device) repeatedly changes the HRTFs processing the voice of the second user. For instance, these changes continue until the coordinates $(\theta, \phi)$ of the HRTF pair equal or approximate the head orientation $(\theta2, \phi2)$ while the first user looked at the SLP where the voice of the second user externally localized as binaural sound to the first user.

Consider an example embodiment in which the electronic device determines that HRTF coordinates $(\theta, \phi)$ equal the second head direction $(\theta2, \phi2)$ while the face of the first user pointed in the direction of the SLP where the voice of the second user externally localized as binaural sound to the first user. Upon or after making this determination, the electronic device displays (or causes a display to display to the first user) an image that represents the second user. This image occurs at coordinates (θ, ϕ) after and in response to the determining that the coordinates (θ, ϕ) equal the second head direction (θ2, ϕ2) while the face of the first user pointed in the direction of the SLP where the voice of the second user externally localized as binaural sound to the first user.

Consider an example embodiment in which a WED plays 3D or binaural sound as a test sound or alarm (e.g., a ringtone to signify an incoming telephone call) to determine an error or discrepancy between, or to confirm, reconfirm, calibrate, recalibrate, or synchronize the coordinates of the HRTFs and the direction of the location where the user hears the sound. The WED processes the test sound with the HRTFs and plays this sound through speakers in the WED. The WED then tracks head movements of the user to determine coordinates (e.g., an azimuth coordinate and/or elevation coordinate) while the user looks at an origin of the test sound that occurs in empty space away from but proximate to the user. The WED then calculates an error by comparing the coordinate locations of the HRTFs with coordinates of the direction faced by the head of the user looking at the sound localization point of the test sound. For example, the WED compares the azimuth angle and/or elevation angle of the HRTFs that convolve the test sound that occurs in empty space with the azimuth angle and/or elevation angle of the head orientation of the user while the user looks at the sound localization point.

For example, the WED processes the ringtone with the HRTFs and plays the ringtone processed with the HRTFs before providing the first user with the voice of the second user processed with the HRTFs. The WED then measures, with the head tracking, an azimuth angle θ3 (relative to the azimuth angle of the head prior to playing the ringtone) while the face of the first user points in a direction of an origin of the ringtone that occurs in empty space and calculates an error of (|θ1−θ3|). The WED then changes the HRTFs processing the voice of the second user in response to calculating that the error of (|θ1−θ3|) is greater than a threshold value of ten degrees (10°) or fifteen degrees (15°).

In some instances, an example embodiment ignores the error or decides not to correct the error (e.g., decides not to change or alter the HRTFs processing the sound being provided to the user). This situation occurs, for example, when the error is minor or insignificant. For example, some errors are minor or small enough that the listener is not able to discern the error from an auditory point of view. For instance, the electronic device ignores or fails to correct the error when the difference between the coordinates (θ1, ϕ1) of the HRTFs processing the voice of the second user and the directional coordinates (θ2, ϕ2) of the head orientation is equal to or less than a value or amount, such as twenty degrees) (20°) azimuth and/or twenty degrees (20°) elevation, fifteen degrees (15°) azimuth and/or fifteen degrees (15°) elevation, ten degrees (10°) azimuth and/or ten degrees (10°) elevation, five degrees (5°) azimuth and/or five degrees (5°) elevation, or three degrees (3°) azimuth and/or three degrees (3°) elevation.

Consider an example embodiment of a WED (alone or in combination with one or more other electronic devices) that corrects errors relating a sound localization point (SLP) for a telephone call or other electronic communication. For example, the communication occurs between a first user wearing the WED and a second user with an electronic device. The WED includes a processor (such as a DSP) that processes the voice of the second user with HRTFs with spherical coordinates (r1, θ1, ϕ1), where r1 is a distance from the head of the first user to a source of the sound, θ1 is an azimuth angle to the source of sound, and ϕ1 is an elevation angle to the source of sound. The WED includes head tracking (such as one or more of an accelerometer, gyroscope, magnetometer, inertial sensor, MEMs sensor, a chip that provides three-axis measurements, etc.) that track head movements or head orientations of the first user. Speakers (such as those in the WED or in communication with the WED) play the voice of the second user processed with the HRTFs so the voice of the second user externally localizes as binaural sound in empty space to (r2, θ2, ϕ2). Here, r2 is a distance from the first user to the location in empty space of the voice of the second user; θ2 is an azimuth angle relative to the first head orientation of the first user looking at the location in empty space where the voice of the second user externally localized to the first user; and ϕ2 is an elevation angle relative to the first head orientation of the first user looking at the location in empty space where the voice of the second user externally localized to the first user. A processor in the WED (or in communication with the WED) executes instructions stored in memory to perform the one or more of the following:

(1) calculate or measure, during the telephone call, an azimuth error that is a difference between the θ1 and the θ2;
(2) calculate or measure, during the telephone call, an elevation error that is a difference between the ϕ1 and the ϕ2;
(3) correct or reduce, during the telephone call, the azimuth error by changing the azimuth coordinate of the HRTFs processing the voice of the second user when the azimuth error reaches a predetermined azimuth value; and
(4) correct or reduce, during the telephone call, the elevation error by changing the elevation coordinate of the HRTFs processing the voice of the second user when the elevation error reaches a predetermined elevation value.

Consider further this example of the WED in which the WED measures, with head tracking, a change of yaw and a change of head pitch of the head of the first user in response to the first user hearing the voice of the second user. Hearing this sound causes the first user to change a head orientation and face a location in empty space or occupied space where the first user externally localized the voice of the second user at a fixed location in empty space or occupied space. The WED (or an electronic device in communication with the WED) performs the following:

(1) calculates or determines an azimuth error of the HRTFs processing the voice of the second user by comparing the change of yaw to the azimuth angle θ1;
(2) calculates or determines an elevation error of the HRTFs processing the voice of the second user by comparing the change of head pitch to the elevation angle ϕ1;
(3) corrects or reduces the azimuth error by changing the HRTFs processing the voice of the second user when the azimuth error reaches a first predetermined value; and
(4) corrects or reduces the elevation error by changing the HRTFs processing the voice of the second user when the elevation error reaches a second predetermined value.

Consider further this example embodiment of the WED in which the predetermined azimuth value and the predetermined elevation value are equal to or greater than a predetermined value, such as three degrees (3°), five degrees (5°), ten degrees (10°), or fifteen degrees (15°).

Consider further this example embodiment of the WED in which the processor further executes the instructions stored in memory to determine that the azimuth and elevation coordinates of the HRTFs match the θ2 and the ϕ2 respectively where the first user is looking at the location in empty space where the voice of the second user externally localized to the first user. The WED includes a display (or is in communication with a display) that displays an image representing the second user at spherical coordinates (r, θ, ϕ) only upon a determination that the azimuth and elevation coordinates of the HRTFs match the respective θ2 and the ϕ2 where the first user is looking at the location in empty space where the voice of the second user externally localized to the first user.

Consider further this example embodiment of the WED in which the processor further executes the instructions stored in memory to select, during the telephone call, new or different HRTFs based on an anatomy of a different user that is not the first user when the difference between the θ1 and the θ2 (e.g., an azimuth error) is greater than forty-five degrees (45°). For instance, these different HRTFs are retrieved from a database or other memory that stores HRTFs for users. The processor then processes the voice of the second user with these different HRTFs.

By way of example, after playing to the user a sound convolved to (θ1, ϕ1) and determining the localization by the user, the WED calculates the azimuth error as an absolute value of a difference in degrees between the azimuth angle θ1 and the change of yaw when the first user changes the head orientation and faces the location in empty space where the first user externally localized the voice of the second user at the fixed location in empty space in response to hearing the voice of the second user. The WED calculates the elevation error as an absolute value of a difference in degrees between the elevation angle ϕ1 and the change of pitch when the first user changes the head orientation and faces the location in empty space where the first user externally localized the voice of the second user at the fixed location in empty space in response to hearing the voice of the second user.

Consider an example embodiment that selects new or different HRTFs when an error is detected between the coordinates of the HRTFs processing the sound and the coordinates where the user hears or heard the sound. For example, the electronic device retrieves HRTFs based on an anatomy of a different user that is not the user hearing the sound or being provided the sound. As another example, the electronic device captures or measures HRTFs in real-time for the user. As another example, the electronic device interpolates or estimates HRTFs based on knowing the error or difference between the coordinates of the HRTFs processing the sound and the coordinates where the user hears the sound. For instance, an adjustment or change is made to the ITD, ILD, impulse response, etc.

Consider an example in which a digital signal processor in the electronic device processes sound with HRTFs having coordinates (θ1, ϕ1) and plays the sound through speakers located in or near the ears of the user (e.g., in headphones, earphones, earbuds, etc.). The user hears the sound as binaural sound that externally localizes away from but proximate to the user (e.g., within three meters) at a coordinate location (θ2, ϕ2). The electronic device calculates an error as a difference between (θ1, ϕ1) and (θ2, ϕ2). Based on this difference, the electronic device determines how to or whether to correct and/or reduce the error. For instance, the electronic device performs one of the following:

(1) Correct the error when the difference between the ϕ1 and the ϕ2 is greater than forty-five degrees (45°).
(2) Select new HRTFs based on an anatomy of a different user that is not the first user when $0° < \theta1 < 180°$ and $0° > \theta2 > 180°$.
(3) Select new HRTFs based on an anatomy of a different user that is not the first user when $0° < \phi1 < 90°$ and $0° >> 90°$.
(4) Select different HRTFs based on an anatomy of a different user that is not the first user when $20° < \theta1 < 60°$ and the first user changes the head orientation in a negative azimuth direction in response to hearing the voice of the second user.
(5) Select different HRTFs based on an anatomy of a different user that is not the first user when $10° < \phi1 < 45°$ and the first user changes the head orientation in a negative elevation direction in response to hearing the voice of the second user Consider an example embodiment of a wearable electronic device (WED) that corrects or reduces errors relating to where a first user hears a voice of a second user during a telephone call or electronic communication between the first user and the second user. The WED includes a memory, head tracking, one or more processors (including a DSP), and two speakers with one speaker located at, near, or in each ear of the user.

The memory in the WED stores HRTFs with spherical coordinates (r, θ, ϕ), where r is a distance to a sound source, θ is an azimuth angle to the sound source, and ϕ is an elevation angle to the sound source. These HRTFs can be generic HRTFs or individualized or customized to the user. In an example embodiment, the HRTFs are stored in memory of the WED to provide fast access by the DSP that is also located in the WED.

The head tracking in the WED tracks head orientations or head movements of the first user during the telephone call or electronic communication.

The DSP in the WED processes sound (including voice) so the sound externally localizes to the first user as binaural sound or 3D sound. Localization occurs away from the head of the first user. Preferably, for telephone calls or electronic communications, the sound localizes proximate to the first user (e.g., about one meter to about three meters from the user).

During the telephone call or electronic communication, the processor and/or DSP processes the voice of the second user with the HRTFs so the voice of the second user externally localizes as binaural sound to a location in empty space. The processor further determines the error where the user hears the binaural sound by comparing the head orientation coordinates when the user looks at the location in empty space where the binaural sound processed with the pair of the HRTFs externally localized to the user to the coordinate location of the pair of the HRTFs. The processor then corrects the error where the user hears the binaural sound when the error is greater than a predetermined or updated value.

Consider an example embodiment in which the WED analyzes a magnitude of the error in order to decide whether to correct the error or how to correct the error. For instance, the WED selects a different pair of the HRTFs to process the sound when a difference between the coordinate location where the user looks at the location in empty space and the coordinate location of the HRTFs that processed the sound is greater than or equal to a predetermined value, such as five degrees (5°) azimuth and/or elevation, ten degrees (10°) azimuth and/or elevation, etc. By contrast, the WED selects to ignore and to not correct the error when the error is greater than or less than a predetermined value. For instance, the WED records the error but does not alter the HRTFs processing the sound in response to detecting the error. The error is corrected at a later or different time (e.g., after the user finishes listening to the sound).

Consider an example in which the processor reduces the error by changing the pair of the HRTFs processing the sound while the user looks or gazes at the location in empty space without moving his or her head. Here, the processor selects a different pair of the HRTFs based on a user having different physical attributes than the user when a gaze angle of the user changes more than a large amount (such as one of thirty degrees (30°), forty-five degrees (45°), sixty degrees (60°), or ninety degrees (90°)).

Consider an example embodiment in which the WED repeatedly or iteratively determines a difference between the direction coordinates where the user gazes or focuses at the location in empty space where the binaural sound processed with the pair of the HRTFs externally localized to the user, to the location coordinates of the pair of the HRTFs presently convolving the sound. This process repeats continuously, continually, or periodically until the difference is less than or equal to a predetermined value. For example, continue determining the difference until the difference is less than or equal to one of ten degrees (10°), nine degrees (9°), eight degrees (8°), seven degrees (7°), six degrees (6°), five degrees (5°), four degrees (4°), three degrees (3°), two degrees (2°), one degree) (1°), or zero degrees (0°). In other words, the head remains motionless but the gaze is monitored. While the gaze is monitored the HRTFs change (e.g., different sets of HRTFs are tried) until the coordinates of the HRTF pair being used to cause a localization of a sound fall within a certain number of degrees of the gaze angle of the user looking toward the localization.

In an example embodiment, when the difference reaches a predetermined level, the WED displays (or instructs a display to display) an image. This process ensures that the image is displayed at the location where the user hears the sound so the sound and the image appear at the same or similar locations to the user. For instance, the WED during a telephone call transmits a signal to a head mounted display to display an image at the location in empty space where the binaural sound processed with the pair of the HRTFs externally localized to the user after and in response to determining that the error where the user hears the binaural sound is below the predetermined value.

In an example embodiment, the sound is a test sound, an alarm sound, or another sound. For example, in a telephone call, the sound is a ringtone indicating an incoming telephone call to the user. The processor determines the error where the user hears the binaural sound before the user answers the incoming telephone call based on where the user looks upon hearing the ringtone.

Figure 2:
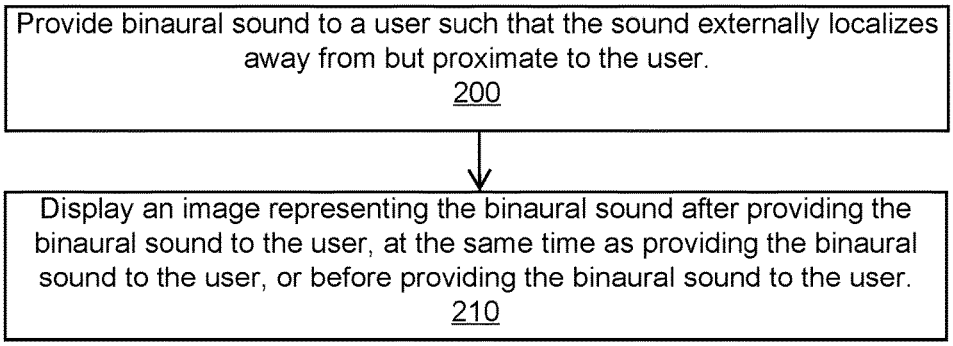
FIG. 2 is a method that corrects errors or differences where a user hears binaural sound in accordance with an example embodiment.

FIG. 2 is a method that corrects errors or differences where a user hears binaural sound in accordance with an example embodiment.

Block 200 states provide binaural sound to a user such that the sound externally localizes away from but proximate to the user.

Two or more speakers play the sound to the user so that the user hears the sound as 3D sound or binaural sound. For example, the speakers are in an electronic device or in wired or wireless communication with an electronic device. For instance, the speakers include, but are not limited to, headphones, electronic glasses with speakers for each ear, earbuds, earphones, head mounted displays with speakers for each ear, and other wearable electronic devices with two or more speakers that provide binaural sound to the listener.

For example, the sound externally localizes in empty space or space that is physically occupied with an object (e.g., localizing to a surface of a wall, to a chair, to a location above an empty chair, etc.).

In an example embodiment, the sound localizes proximate to the user (e.g., within about three meters from the head of the listener). In another example embodiment, the sound localizes farther away (e.g., more than three meters from the head of the listener).

Block 210 states display an image representing the binaural sound after providing the binaural sound to the user, at the same time as providing the binaural sound to the user, or before providing the binaural sound to the user.

One or more example embodiments address the following important question: When in time should the image representing the sound be displayed to the user? If the image is not displayed at the correct time, then problems result when the perceived location of the sound does not match or coincide with the perceived location of the image. The following three options exist for when to display the image to the user:

(1) display the image before the sound externally localizes to the user;
(2) display the image at the same time as the sound externally localizes to the user; or
(3) display the image after the sound externally localizes to the user.

One advantage of displaying the image before the sound externally localizes to the user is that the location of the image provides a visual cue or indication as to where the sound will appear. This visual indication assists the user in resolving a conflict or discrepancy between the location of the sound and the location of the image when this discrepancy or difference is small (e.g., less than about 20° azimuth and/or 20° elevation).

Consider an example in which the electronic device displays the image at an (r, θ, ϕ) equal to (1.0 m, 40°, 0°) before the sound externally localizes to the user. The electronic device then provides the sound to the user, and the user localizes the sound to (1.0 m, 25°, 0°). Here, an azimuth difference is |40°−25°| or 15°. The user, however, will subconsciously attempt or instinctively attempt to align the origin of the sound with the visual location of the image. Since the image was provided first, the user will be more likely to believe that the origin of the sound occurs at the visual location of the image even though these two locations are 15° apart from the point of view of the user.

One disadvantage of displaying the image before the sound externally localizes to the user is that the user becomes more confused about the location of the sound when the discrepancy between the location of the sound and the location of the image is great (e.g., greater than about 20° azimuth and/or 20° elevation).

Consider an example of a telephone call in which a wearable electronic device displays an image of a calling party and processes the voice of the calling party so the location of the voice and the location of the image coincide to a user (i.e., the called party in this example). A display of the electronic device displays the image of the calling party to the user at an (r, θ, ϕ) equal to (1.0 m, 40°, 0°) before a voice of a calling party externally localizes to the user. The electronic device then provides the voice to the user, and the user localizes the voice to (1.0, −40°, 0°). Here, an azimuth difference is |−40°−40°| or 80°. This difference is great since the image and the voice originate from two different and distinct locations to the user. In this instance, the user will not be able to resolve or overlook this difference in location of the perception of the image and the perception of the sound and will be confused as to who is talking or where the origin of the voice originates.

One advantage of displaying the image at the same time as the sound externally localizes to the user is that this situation closely emulates real life situations. Users typically see and hear the source of sound at the same time. Displaying the image and providing the sound at the same time also assists the user in resolving a conflict or discrepancy between the location of the sound and the location of the image when this discrepancy or difference is small (e.g., less than about 20° azimuth and/or 20° elevation).

One disadvantage of displaying the image at the same time that the sound externally localizes to the user is that the user becomes more confused about the location of the sound when the discrepancy between the location of the sound and the location of the image is great (e.g., greater than about 20° azimuth and/or 20° elevation). This disadvantage is similar to the disadvantage of displaying the image before providing the sound to the user.

One advantage of displaying the image after the sound externally localizes to the user is that the electronic device has time to correct an error or discrepancy before the image is displayed to the user. This error can be quickly remedied (e.g., in some instances in less than a second) which minimizes its impact on the experience of the user.

Alternatively, the electronic device changes the location of the image to match or coincide with the direction from where the user hears the sound. As such, the user is unaware of an error since a correction to the location of sound is not required. A location of the sound is not moved in response to the error. Instead, a location of the image is adjusted according to the size and direction of the error in order to match the direction of the SLP of the user as opposed to changing the location or processing of the sound.

Consider an example in which the electronic device does not display the image before or simultaneously with the sound. Instead, the electronic device first provides the sound to the user, for example at an (r, θ, ϕ) equal to (1.0 m, 10°, 0°). When the user first hears the sound, the user turns his or her head to where the origin of the sound appears to the user, for example at (1.0 m, 40°, 0°). Here, an azimuth difference is |10°−40° or 30°. Importantly, the user is not aware of this difference at this time since the image has not yet been displayed to the user. Further, the user may not be aware of the coordinate location of the HRTFs processing the sound and thus unaware that a potential error even exists. In this instance, the electronic device has several options to fix or remedy this error.

As one option, the electronic device displays the image at the location where the user turned his or her head. In this example, the electronic device displays the image at (1.0 m, 40°, 0°) relative to the direction of orientation of the face of the user at the time when the user heard the sound before reacting and turning his or her head, since this is the direction from where the user heard the origin of the sound. Placement or display of the image can be immediately after the user turns his or her head to the location such that the image seems to the user to simultaneously appear at the same time or nearly at the same time as the commencement of the sound. For instance, the image appears or displays at the point in time when the user stops moving his or her head or otherwise indicates with head movement or eye movement the location where the user hears the sound.

In this first option, if the head of the user is not moved (e.g., the error is calculated from a gaze angle or another way) the electronic device is not required to change or alter the HRTFs processing or convolving the sound to compensate for the error. Instead of changing the HRTFs, the electronic device displays the image to the location where the user hears the sound. This solution saves processing resources and provides a quick and effective solution to displaying an image with binaural sound that externally localizes to the user, particularly in situations where the HRTFs are imperfectly suited to the user. Here, instead of altering the location of the sound, the electronic device places the image at the location that coincides with the direction from which the user hears the sound emanating.

With this first option, the image is not displayed at the coordinate location of the HRTFs but displayed away from the user in the direction where the user perceives the sound as originating. This solution would not be possible if the electronic device displayed the image before the sound or simultaneously with the sound, without the electronic device displaying the image at a location that appears wrong to the user and then moving the image.

As a second option, if the head of the user remains in a first orientation or does not face the SLP (e.g., the electronic device determines the direction of localization to the user without the head moving such as through a gaze or verbal indication) the electronic device changes or alters the HRTFs that process the sound so the coordinate locations of the HRTF pairs match or approximate the direction from which the user hears the origin of the sound. Here, coordinate locations of the changed HRTFs match or coincide with the coordinate locations of where the user perceives the origin of the sound. For example, the electronic device selects a different HRTF pair in an attempt to match the coordinate locations of the HRTF pair with the coordinate location where the user hears the sound.

By way of example, the electronic device selects the HRTFs based on measurements of the user (e.g., measuring HRIRs of the user), HRTFs selected from a database (e.g., a database of known HRTFs for other users), or computer simulation or generation (e.g., a program that simulates or approximates HRTFs for the user based on a photo of the user, measurements of the size and/or shape of the head of the user, measurements of the size and/or shape of the ear or pinnae of the user, etc.).

Consider an example embodiment in which a wearable electronic device provides a telephone call or other electronic communication to a first user who communicates with a second user. These two users plan to meet and talk to each other in a virtual chat room or other virtual location. The first user will see a virtual reality (VR) image of the second user, and the second user will see a VR image of the first user as they talk to each other at the location. An electronic device processes the voice of the second user so the first user will hear this voice originate from the location of the VR image of the second user that the first user sees. This electronic device, however, is not certain where the first user will localize the voice of the second user (e.g., the electronic device does not have confirmed or known HRTFs that are customized for the first user or has not previously processed sound for the first user). As such, the electronic device selects to provide the first user with the voice of second user before providing the image of the second user to the first user. The electronic device processes a sound of a telephone ringing with HRTFs having spherical coordinates (1.0 m, 10°, 0°) and plays this ringing sound to the first user. When the first user hears the ringing sound, the first user turns his head to (1.0 m, 40°, 0°), which represents the location where the first user hears the processed sound in the VR location. The instant or moment that the electronic device determines the location and/or direction where the first user looked to the ringing sound, the electronic device knows the magnitude and/or direction of the error. The electronic device calculates the error or difference between (1.0 m, 10°, 0°) and (1.0 m, 40°, 0°) as being 30° in the azimuth plane. The electronic device then displays the VR image of the second user at (1.0 m, 40°, 0°) relative to the first head orientation since this is the location where the first user hears the sound even though this coordinate location does not match the coordinate location associated with the HRTFs.

One advantage of providing the binaural sound to the user before displaying the image is that the electronic device can cure or correct an error (if one exists) without assistance or feedback from the user. For example, the user is not required to train the electronic device before the telecommunication such as to point to the location where he or she hears the sound or to interact with the electronic device to indicate where the SLP is heard. Instead, the user merely looks at the SLP, and the electronic device determines whether an error exists, the size of the error, and whether and/or how to correct the error. For example, users instinctively look at the origin of the sound since people often turn toward or glance toward a sound emanation when they first hear the sound, especially when the sound is a voice. Alternatively, the user knows or is instructed to look at the origin of the sound when the user first hears the sound. For example, when the user hears a predetermined sound (e.g., a particular chime, cue, tone, alarm, voice such as a voice of an IPA, speech such as "please gaze here; now please face here," etc.), then the user knows to look toward the origin of the localization in order to assist the electronic device in properly localizing sound to the user and properly providing images to origins of sound.

Consider an example embodiment in which the electronic device plays a 3D sound to the user having a first head orientation. The position of the 3D sound is fixed with respect to the room or fixed in space and convolved with an HRTF pair associated with ($\theta 1$, $\phi 1$). The user reacts to the sound convolved to ($\theta 1$, $\phi 1$) by changing to a second head orientation in which his head faces the origin of the sound. The electronic device tracks head movements relative to the first head orientation, and determines that the angular coordinates ($\theta 1$, $\phi 1$) of the HRTF pair that processed the sound at the first head orientation equal the angles of the current and second head orientation ($\theta 2$, $\phi 2$) as the user looks at the origin of the 3D sound. An image corresponding to or representing the sound is not initially displayed to the user. After the user turns his or her head toward the direction of the sound, the electronic device interprets the data from the head tracker and knows that the head of the user is facing the direction ($\theta 2$, $\phi 2$), that $\theta 2$ matches $\theta 1$, and that $\phi 2$ matches $\phi 1$. At this moment in time when the head of the user is facing the SLP, the electronic device displays an image that represents the sound along the coordinates ($\theta 2$, $\phi 2$) relative to the first head orientation from which the user localized the sound and before the user turned his or her head to face the sound. Here, in response to determining or confirming that the HRTF coordinates ($\theta 1$, $\phi 1$) that convolved the sound for the user in the first head orientation equal, match, or approximate the second head orientation ($\theta 2$, $\phi 2$) while the user looks at the SLP, the electronic device displays the image where the sound externally localizes as 3D sound to the user. In this way, the electronic device prevents the image from displaying at the wrong location since the user will become confused if the location of the image and the emanation of the sound associated to the image do not align or coincide.

Consider an example embodiment of a WED that executes the above or similar method two or more times upon the event of a user or a different user (e.g., a different user logs in or couples to the WED from a PED of the different user) powering on and/or donning the WED. For example a user hands the WED to a different user who then wears the WED. The WED is notified that a different user is wearing the WED and this triggers the WED to measure the error for two or more points in succession. For example the WED causes three sounds to localize to three different coordinates with each next sound being triggered to play after the WED confirms that a sound is perceived by the wearer (here, the user or different user) from a location or direction within an acceptable range of error. For example a wearer wears the WED, hears a first localization, and faces the SLP. The WED makes a determination that the directional error in perception of the wearer is within an acceptable range and the determination triggers the WED to play a second sound at a second location. The wearer hears a second localization and turns his or her head to face the second SLP. The WED plays a third sound at another coordinate. The wearer gazes toward the third localization and the WED determines that the gaze direction closely matches the HRTF direction. The WED has confirmed the wearer-perceived accuracy of convolution to three points in space and/or directions, and has identified a set of HRTFs that are compatible with the wearer. The WED plays a confirmation signal to indicate to the wearer and/or other devices that the wearer has successfully synced his or her localization perception to or with the WED and that the WED has identified and can share a suitable set of HRTFs with another device.

Figure 3A:
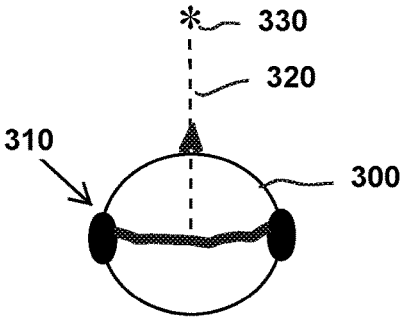
FIG. 3A shows a top view with azimuth coordinates of a user looking straight ahead before turning to look at a location where sound is convolved with a pair of HRTFs in accordance with an example embodiment.

FIG. 3A shows a top view with azimuth coordinates of a user 300 looking straight ahead before turning to look at a location where sound is being convolved with a pair of HRTFs in accordance with an example embodiment.

The user 300 wears a WED 310 (e.g., shown as headphones but example embodiments include other types of WEDs). Initially, the user 300 looks in a first direction 320 with a first head orientation. By way of example, the user is looking at an object or location 330 (e.g., a location in empty space, an area, or a physical object).

Example embodiments are not limited to a particular first direction or first head orientation. Further, the user 300 is not required to look at an object. For example, a change in the head orientation of the user is expressed in terms of a change in yaw, pitch, and roll coordinates. For example, a first head orientation is expressed as having a yaw, pitch and roll of (0°, 0°, 0°) or other values. For example, a crown of the head of the user is defined as facing upward and a face of the user is defined as facing straight forward or in a forward-looking direction (e.g., with azimuth and elevation ($\theta$, $\phi$) of (0°, 0°) or other values).

For example, consider a convention of spherical coordinates being associated with HRTF pairs wherein the origin of the spherical coordinate space is the center of the head of the user and the forward looking direction of the user is defined as the direction in which both the azimuth and elevation measure zero degrees. Further consider similarly a convention defining a change in yaw with respect to the vertical axis through the center of the head at the first head orientation and a change in pitch with respect to the lateral axis through the center of the head at the first head orientation at which the yaw and pitch are defined as having a measure of zero. In this situation, a change in head orientation in degrees of yaw and pitch correlates to a change in localization in degrees of azimuth and elevation respectively, aiding calculation and comparison between movement of the user and adjustment of the convolution of sound. Example embodiments are not limited to particular coordinate systems, are not limited to less than three dimensions, and do not limit user movement in degrees of freedom or to less than three axes of rotation.

Figure 3B:
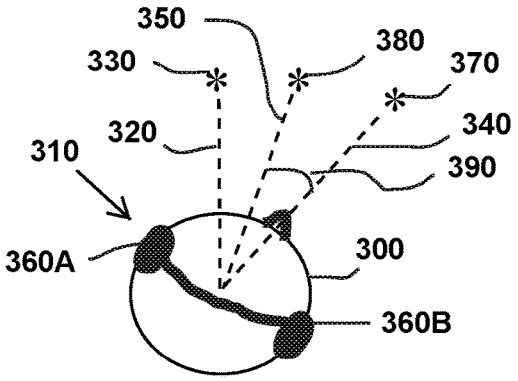
FIG. 3B shows the top view with azimuth coordinates to illustrate an error between the coordinate direction where the user looks where the binaural sound processed with the pair of HRTFs externally localized to the user and the coordinate direction of the pair of HRTFs that processed the sound in accordance with an example embodiment.

FIG. 3B shows the top view with azimuth coordinates to illustrate an error between the coordinate direction 340 where the user looks where the binaural sound processed with the pair of HRTFs externally localized to the user and the coordinate direction 350 of the pair of HRTFs that processed the sound in accordance with an example embodiment.

The WED 310 processes sound, and plays the processed sound as 3D or binaural sound to the user through two speakers (left speaker 360A and right speaker 360B). When the user hears the sound, he or she turns to face or look at the location where the sound is emanating. The head orientation of the user changes such that the face of the user is pointing in a second direction 340 with a second head orientation.

For illustration, FIG. 3B shows the user facing and looking at a coordinate location 370 that is along the line-of-sight of coordinate direction 340 where the user is looking. This location 370 shows where the user hears the sound originating. For example, this location is away from but proximate to the user (e.g., within three meters from the head of the user). Alternatively, this location is farther away (e.g., greater than three meters).

By way of example, the processor processes the sound with a pair of HRTFs that have spherical coordinates (r, θ, ϕ), where r represents a distance from the head of the user to the source of sound, θ represents an azimuth coordinate or angle to the source of sound, and ϕ represents an elevation coordinate or angle to the source of sound. For illustration, the coordinate location (r, θ, ϕ) of the HRTFs processing the sound are shown at location 380.

FIG. 3B shows an error or difference between the coordinate direction 350 and/or coordinate location 380 of the HRTFs processing the sound and the coordinate direction 340 and/or coordinate location 370 from where the user hears the sound emanating or originating. This difference or error is shown as the azimuth angle error ($\theta_{error}$) at 390.

Example embodiments also include determining, measuring, calculating, correcting, and/or reducing a difference or error for elevation as well, an elevation angle error ($\phi_{error}$).

Consider an example in which the WED convolves the sound to location 380 with a pair of HRTFs having coordinates (1.0 m, 25°, 0°) with respect to a forward-looking direction of the user. The WED convolves and plays the sound at an initial time when the orientation of the head of the user is facing a location 330 and in which the yaw, pitch, and roll of the head of the user are said to be (0°, 0°, 0°). When the user hears the sound, the head of the user turns or rotates to face the location that he or she localizes as the origin of the sound, and so he or she looks at location 370 having coordinates (1.0 m, 45°, 0°). Here the differences in locations or directions between where the WED convolved the sound 350 and where the user heard the sound 340 are |(1.0 m, 25°, 0°)−(1.0 m, 45°, 0°)|. This difference or azimuth angle error ($\theta_{error}$) is 15°.

Figure 4:
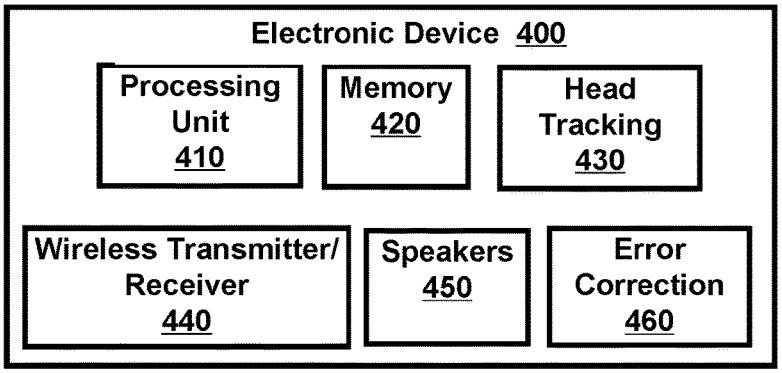
FIG. 4 is a wearable electronic device in accordance with an example embodiment.

FIG. 4 shows an example of an electronic device 400 in accordance with an example embodiment.

The electronic device 400 includes a processor or processing unit 410, memory 420, head tracking 430, a wireless transmitter/receiver 440, speakers 450, and error correction 460.

The processor or processing unit 410 includes a processor and/or a digital signal processor (DSP). For example, the processing unit includes one or more of a central processing unit, CPU, digital signal processor (DSP), microprocessor, microcontrollers, field programmable gate arrays (FPGA), application-specific integrated circuits (ASIC), etc. for controlling the overall operation of memory (such as random access memory (RAM) for temporary data storage, read only memory (ROM) for permanent data storage, and firmware).

Consider an example embodiment in which the processing unit includes both a processor and DSP that communicate with each other and memory and perform operations and tasks that implement one or more blocks of the flow diagram discussed herein. The memory, for example, stores applications, data, programs, algorithms (including software to implement or assist in implementing example embodiments) and other data.

For example, a processor or DSP executes a convolving process with the retrieved HRTFs or HRIRs (or other transfer functions or impulse responses) to process sound so that the sound is adjusted, placed, or localized for a listener away from but proximate to the head of the listener. For example, the DSP converts mono or stereo sound to binaural sound so this binaural sound externally localizes to the user. The DSP can also receive binaural sound and move its localization point, add or remove impulse responses (such as RIRs), and perform other functions.

For example, an electronic device or software program convolves and/or processes the sound captured at the microphones of an electronic device and provides this convolved sound to the listener so the listener can localize the sound and hear it. The listener can experience a resulting localization externally (such as at a sound localization point (SLP) associated with near field HRTFs and far field HRTFs) or internally (such as monaural sound or stereo sound).

The memory 420 stores HRTFs, HRIRs, BRTFs, BRIRs, RTFs, RIRs, or other transfer functions and/or impulse responses for processing and/or convolving sound. The memory can also store instructions for executing one or more example embodiments.

The head tracking includes hardware and/or software to determine or track head orientations of the wearer or user of the electronic device. For example, the head tracking tracks changes to head orientations or changes in head movement of a user while the user moves his or her head while listening to sound played through the speakers 450. Head tracking includes one or more of an accelerometer, gyroscope, magnetometer, inertial sensor, MEMs sensor, camera, or other hardware to track head orientations.

Error correction 460 includes hardware and/or software to execute one or more example embodiments that correct error where a user hears 3D or binaural sound (e.g., one or more blocks discussed in connection with FIGS. 1 and 2). For example, the error correction includes instructions or program code to determine a difference between a coordinate location or coordinate direction of where a user hears binaural sound and a coordinate location or coordinate direction of where a processor processed the binaural sound (e.g., coordinate locations of HRTFs convolving sound).

For example, microphones in a smartphone or WED capture mono or stereo sound and transmit this sound to an electronic device in accordance with an example embodiment. This electronic device receives the sound, processes the sound with HRTFs of the user, and provides the processed sound as binaural sound to the user through two or more speakers. For instance, this electronic device communicates with the smartphone during a telephone call between a first user of the smartphone and a second user of the electronic device in accordance with an example embodiment. Alternatively, both users use an electronic device in accordance with an example embodiment.

In an example embodiment, sounds are provided to the listener through speakers, such as headphones, earphones, stereo speakers, etc. The sound can also be transmitted, stored, further processed, and provided to another user, electronic device or to a software program or process (such as an intelligent user agent, bot, intelligent personal assistant, or another software program).

Figure 5:
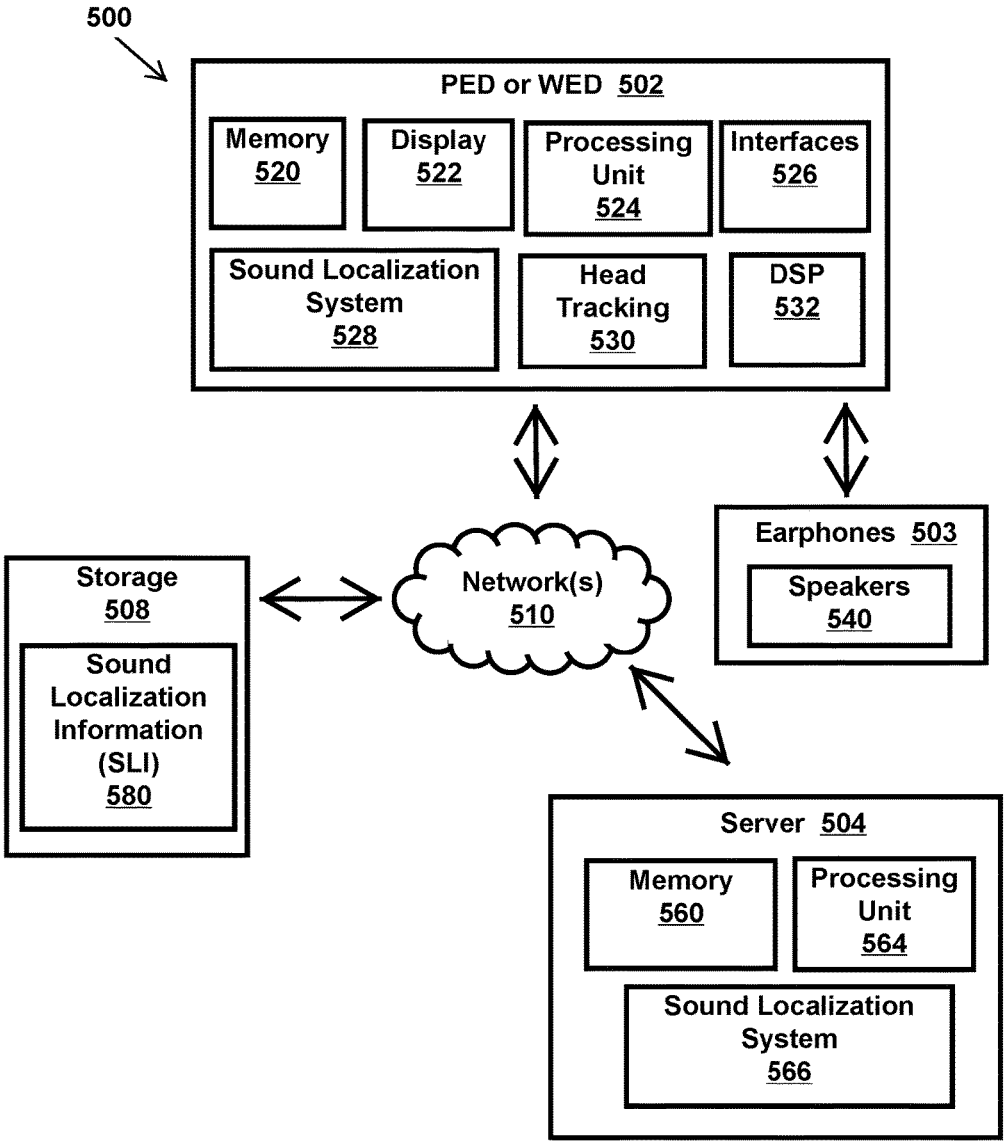
FIG. 5 is an electronic system or computer system in accordance with an example embodiment.

FIG. 5 is an electronic system or computer system 500 that provides binaural sound and corrects errors with the sound in accordance with an example embodiment.

The computer system includes a portable electronic device (PED) or wearable electronic device (WED) 502, one or more computers or electronic devices (such as one or more servers) 504, and storage or memory 508 that communication over one or more networks 510. Although a single PED or WED 502 and a single computer 504 are shown, example embodiments include hundreds, thousands, or more of such devices that communicate over networks.

The PED or WED 502 includes one or more components of computer readable medium (CRM) or memory 520 (such as memory storing instructions to execute one or more example embodiments), a display 522, a processing unit 524 (such as one or more processors, microprocessors, and/or microcontrollers), one or more interfaces 526 (such as a network interface, a graphical user interface, a natural language user interface, a natural user interface, a phone control interface, a reality user interface, a kinetic user interface, a touchless user interface, an augmented reality user interface, and/or an interface that combines reality and virtuality), a sound localization system 528, head tracking 530, and a digital signal processor (DSP) 532.

The PED or WED 502 communicates with wired or wireless headphones, earbuds, or earphones 503 that include speakers 540 or other electronics (such as microphones).

The storage 508 includes one or more of memory or databases that store one or more of audio files, sound information, sound localization information, audio input, SLPs and/or zones, software applications, user profiles and/or user preferences (such as user preferences for SLP locations and sound localization preferences), impulse responses and transfer functions (such as HRTFs, HRIRs, BRIRs, and RIRs), and other information discussed herein.

Electronic device 504 (shown by way of example as a server) includes one or more components of computer readable medium (CRM) or memory 560, a processing unit 564 (such as one or more processors, microprocessors, and/or microcontrollers), and a sound localization system 566.

The electronic device 504 communicates with the PED or WED 502 and with storage or memory 508 that stores sound localization information (SLI) 580, such as transfer functions and/or impulse responses (e.g., HRTFs, HRIRs, BRIRs, etc. for multiple users) and other information discussed herein. Alternatively or additionally, the transfer functions and/or impulse responses and other SLI are stored in memory 560 or 520 (such as local memory of the electronic device providing or playing the sound to the listener).

Figure 6:
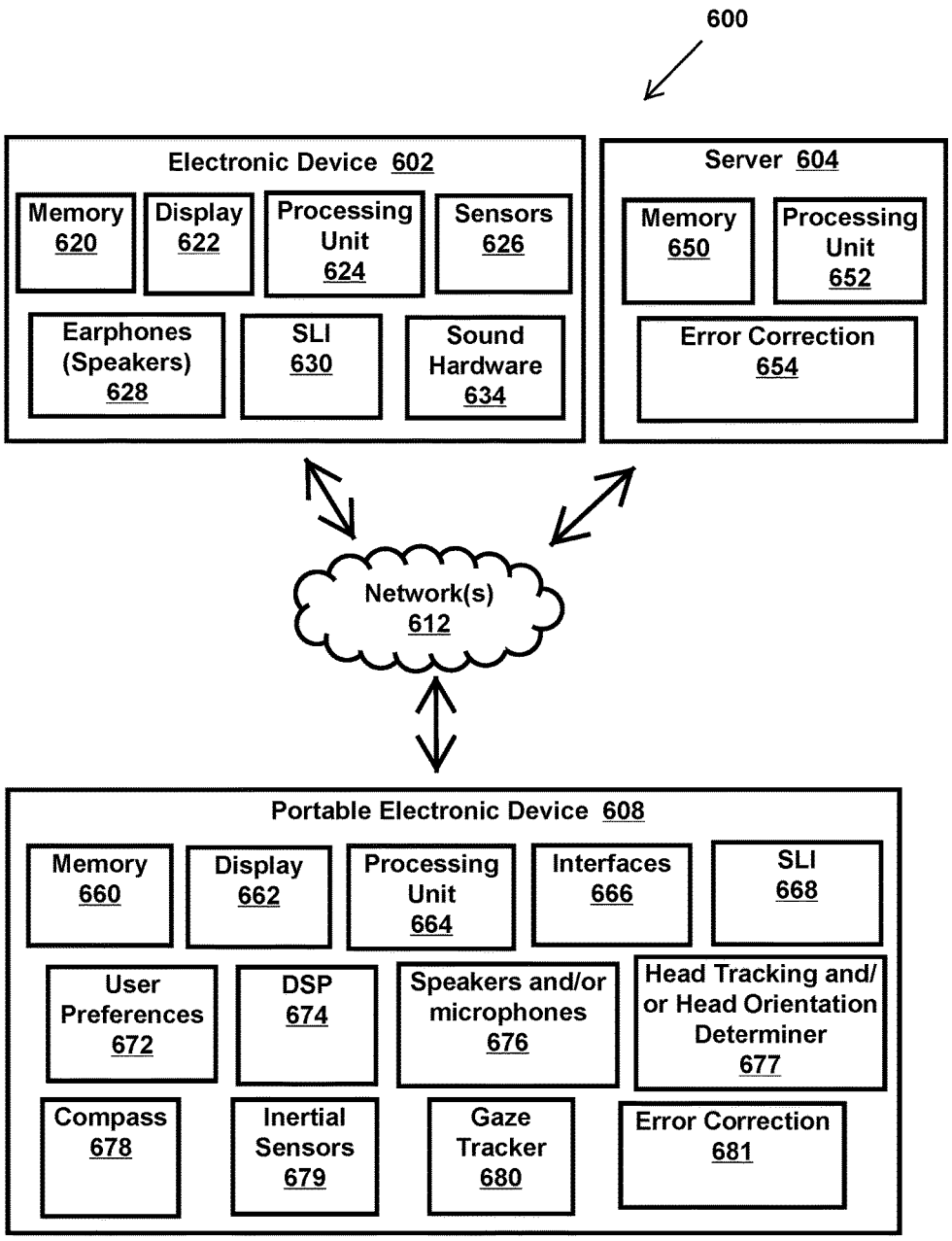
FIG. 6 is an electronic system or computer system in accordance with an example embodiment.

FIG. 6 is a computer system or electronic system in accordance with an example embodiment. The computer system 600 includes an electronic device 602, a computer or server 604, and a portable electronic device 608 (including wearable electronic devices) in communication with each other over one or more networks 612.

Portable electronic device 602 includes one or more components of computer readable medium (CRM) or memory 620, one or more displays 622, a processor or processing unit 624 (such as one or more microprocessors and/or microcontrollers), one or more sensors 626 (such as micro-electro-mechanical systems sensor, an activity tracker, a pedometer, a piezoelectric sensor, a biometric sensor, an optical sensor, a radio-frequency identification sensor, a global positioning satellite (GPS) sensor, a solid state compass, gyroscope, magnetometer, and/or an accelerometer), earphones with speakers 628, sound localization information (SLI) 630, and sound hardware 634.

Server or computer 604 includes computer readable medium (CRM) or memory 650, a processor or processing unit 652, and error correction 654 (e.g., to correct or reduce errors with where the user hears the binaural sound).

Portable electronic device 608 includes computer readable medium (CRM) or memory 660, one or more displays 662, a processor or processing unit 664, one or more interfaces 666 (such as interfaces discussed herein), sound localization information 668 (e.g., stored in memory), user preferences 672 (e.g., coordinate locations and/or HRTFs where the user prefers to hear binaural sound), one or more digital signal processors (DSP) 674, one or more of speakers and/or microphones 676, head tracking and/or head orientation determiner 677, a compass 678, inertial sensors 679 (such as an accelerometer, a gyroscope, and/or a magnetometer), gaze detector or gaze tracker 680, and error correction 681.

The networks include one or more of a cellular network, a public switch telephone network, the Internet, a local area network (LAN), a wide area network (WAN), a metropolitan area network (MAN), a personal area network (PAN), home area network (HAM), and other public and/or private networks. Additionally, the electronic devices need not communicate with each other through a network. As one example, electronic devices couple together via one or more wires, such as a direct wired-connection. As another example, electronic devices communicate directly through a wireless protocol, such as Bluetooth, near field communication (NFC), or other wireless communication protocol.

A sound localization system (SLS) includes one or more of a processor, microprocessor, controller, memory, specialized hardware, and specialized software to execute one or more example embodiments (including one or more methods discussed herein and/or blocks discussed in a method to correct or reduce where a user hears binaural sound). By way of example, the hardware includes a customized integrated circuit (IC) or customized system-on-chip (SoC) to select, assign, and/or designate a SLP and/or zone for sound or convolve sound with SLI to generate binaural sound. For instance, an application-specific integrated circuit (ASIC) or a structured ASIC are examples of a customized IC that is designed for a particular use, as opposed to a general-purpose use. Such specialized hardware also includes field-programmable gate arrays (FPGAs) designed to execute a method discussed herein and/or one or more blocks discussed herein.

The sound localization system performs various tasks with regard to managing, generating, interpolating, extrapolating, retrieving, storing, selecting, and correcting SLPs and function in coordination with and/or be part of the processing unit and/or DSPs or incorporate DSPs. These tasks include generating audio impulses, generating audio impulse responses or transfer functions for a person, correcting or reducing errors where binaural sound externally localizes to the person, selecting SLPs for a user, and executing other functions to provide binaural sound to a user.

By way of example, the sound hardware includes a sound card and/or a sound chip. A sound card includes one or more of a digital-to-analog (DAC) converter, an analog-to-digital (ATD) converter, a line-in connector for an input signal from a sound source, a line-out connector, a hardware audio accelerator providing hardware polyphony, and one or more digital-signal-processors (DSPs). A sound chip is an integrated circuit (also known as a "chip") that produces sound through digital, analog, or mixed-mode electronics and includes electronic devices such as one or more of an oscillator, envelope controller, sampler, filter, and amplifier. The sound hardware is or includes customized or specialized hardware that processes and convolves mono and stereo sound into binaural sound.

By way of example, a computer and an portable electronic device include, but are not limited to, handheld portable electronic devices (HPEDs), wearable electronic glasses, watches, wearable electronic devices (WEDs) or wearables, smart earphones or hearables, voice control devices (VCD), voice personal assistants (VPAs), network attached storage (NAS), printers and peripheral devices, virtual devices or emulated devices (e.g., device simulators, soft devices), cloud resident devices, computing devices, electronic devices with cellular or mobile phone capabilities or subscriber identification module (SIM) cards, digital cameras, desktop computers, servers, portable computers (such as tablet and notebook computers), smartphones, electronic and computer game consoles, home entertainment systems, digital audio players (DAPs) and handheld audio playing devices (e.g., handheld devices for downloading and playing music and videos), appliances (including home appliances), head mounted displays (HMDs), optical head mounted displays (OHMDs), personal digital assistants (PDAs), electronics and electronic systems in automobiles (including automobile control systems), combinations of these devices, devices with a processor or processing unit and a memory, and other portable and non-portable electronic devices and systems (such as electronic devices with a DSP).

Example embodiments are not limited to HRTFs but also include other sound transfer functions and sound impulse responses including, but not limited to, head related impulse responses (HRIRs), room transfer functions (RTFs), room impulse responses (RIRs), binaural room impulse responses (BRIRs), binaural room transfer functions (BRTFs), headphone transfer functions (HPTFs), etc.

Examples herein can take place in physical spaces, in computer rendered spaces (such as computer games or VR), in partially computer rendered spaces (AR), and in mixed reality or combinations thereof.

The processor unit includes a processor (such as a central processing unit, CPU, microprocessor, microcontrollers, field programmable gate arrays (FPGA), application-specific integrated circuits (ASIC), etc.) for controlling the overall operation of memory (such as random access memory (RAM) for temporary data storage, read only memory (ROM) for permanent data storage, and firmware).

The processing unit and DSP communicate with each other and memory and perform operations and tasks that implement one or more blocks of the flow diagrams discussed herein. The memory, for example, stores applications, data, programs, algorithms (including software to implement or assist in implementing example embodiments) and other data.

Consider an example embodiment in which the SLS or portions of the SLS include an integrated circuit FPGA that is specifically customized, designed, configured, or wired to execute one or more blocks discussed herein. For example, the FPGA includes one or more programmable logic blocks that are wired together or configured to execute combinational functions for the SLS, such as convolving mono or stereo sound into binaural sound, correcting or reducing errors where a user hears binaural sound, etc.

Consider an example in which the SLS or portions of the SLS include an integrated circuit or ASIC that is specifically customized, designed, or configured to execute one or more blocks discussed herein. For example, the ASIC has customized gate arrangements for the SLS. The ASIC can also include microprocessors and memory blocks (such as being a SoC (system-on-chip) designed with special functionality to execute functions of the SLS).

Consider an example in which the SLS or portions of the SLS include one or more integrated circuits that are specifically customized, designed, or configured to execute one or more blocks discussed herein. For example, the electronic devices include a specialized or custom processor or microprocessor or semiconductor intellectual property (SIP) core or digital signal processor (DSP) with a hardware architecture optimized for convolving sound and executing one or more example embodiments.

Consider an example in which the HPED (including headphones) includes a customized or dedicated DSP that executes one or more blocks discussed herein (including processing and/or convolving sound into binaural sound and correcting errors where the user hears the binaural sound). Such a DSP has a better power performance or power efficiency compared to a general-purpose microprocessor and is more suitable for a HPED or WED due to power consumption constraints of the HPED or WED. The DSP can also include a specialized hardware architecture, such as a special or specialized memory architecture to simultaneously fetch or pre-fetch multiple data and/or instructions concurrently to increase execution speed and sound processing efficiency and to quickly correct errors while sound externally localizes to the user. By way of example, streaming sound data (such as sound data in a telephone call or software game application) is processed and convolved with a specialized memory architecture (such as the Harvard architecture or the Modified von Neumann architecture). The DSP can also provide a lower-cost solution compared to a general-purpose microprocessor that executes digital signal processing and convolving algorithms. The DSP can also provide functions as an application processor or microcontroller.

Consider an example in which a customized DSP includes one or more special instruction sets for multiply-accumulate operations (MAC operations), such as convolving with transfer functions and/or impulse responses (such as HRTFs, HRIRs, BRIRs, et al.), executing Fast Fourier Transforms (FFTs), executing finite impulse response (FIR) filtering, and executing instructions to increase parallelism.

Consider an example in which the DSP includes the SLS and/or an error correction. For example, the error correction and/or the DSP are integrated onto a single integrated circuit die or integrated onto multiple dies in a single chip package to expedite binaural sound processing.

Consider another example in which HRTFs (or other transfer functions or impulse responses) are stored or cached in the DSP memory or local memory relatively close to the DSP to expedite binaural sound processing.

Consider an example in which a HPED (e.g., a smartphone), PED, or WED includes one or more dedicated sound DSPs (or dedicated DSPs for sound processing, image processing, and/or video processing). The DSPs execute instructions to convolve sound and display locations of SLPs and/or error zones or radii for the sound on a user interface of the HPED. Further, the DSPs simultaneously convolve multiple SLPs to a user. These SLPs can be moving with respect to the face of the user so the DSPs convolve multiple different sound signals and sources with HRTFs that are continually, continuously, or rapidly changing.

An electronic device or computer includes, but is not limited to, handheld portable electronic devices (HPEDs), wearable electronic glasses (e.g., glasses that provide augmented reality (AR), watches, wearable electronic devices (WEDs) or wearables, smart earphones or hearables, voice control devices (VCD), portable computing devices, portable electronic devices with cellular or mobile phone capabilities or SIM cards, digital cameras, portable computers (such as tablets, desktop computers, and notebook computers), smartphones, appliances (including home appliances), head mounted displays (HMDs), optical head mounted displays (OHMDs), personal digital assistants (PDAs), headphones, servers, and other portable and non-portable electronic devices.

As used herein, "about" means near or close to.

As used herein, a "telephone call" is a connection over a wired and/or wireless network between a calling person or user and a called person or user. Telephone calls use landlines, mobile phones, satellite phones, HPEDs, WEDs, voice personal assistants (VPAs), computers, and other portable and non-portable electronic devices. Further, telephone calls are placed through one or more of a public switched telephone network, the internet, and various types of networks (such as Wide Area Networks or WANs, Local Area Networks or LANs, Personal Area Networks or PANs, Campus Area Networks or CANs, private or public ad-hoc mesh networks, etc.). Telephone calls include other types of telephony including Voice over Internet Protocol (VoIP) calls, internet telephone calls, in-game calls, voice chat or channels, telepresence, etc.

As used herein, "headphones" or "earphones" include a left and right over-ear ear cup, on-ear pad, or in-ear monitor (IEM) with one or more speakers or drivers for a left and a right ear of a wearer. The left and right cup, pad, or IEM may be connected with a band, connector, wire, or housing, or one or both cups, pads, or IEMs may operate wirelessly being unconnected to the other. The drivers may rest on, in, or around the ears of the wearer, or mounted near the ears without touching the ears.

As used herein, the word "proximate" means near. For example, binaural sound that externally localizes away from but proximate to a user localizes within three meters of the head of the user.

As used herein, a "user" or a "listener" is a person (i.e., a human being). These terms can also be a software program (including an IPA or IUA), hardware (such as a processor or processing unit), an electronic device or a computer (such as a speaking robot or avatar shaped like a human with microphones in its ears or about six inches apart).

In some example embodiments, the methods illustrated herein and data and instructions associated therewith, are stored in respective storage devices that are implemented as computer-readable and/or machine-readable storage media, physical or tangible media, and/or non-transitory storage media. These storage media include different forms of memory including semiconductor memory devices such as DRAM, or SRAM, Erasable and Programmable Read-Only Memories (EPROMs), Electrically Erasable and Programmable Read-Only Memories (EEPROMs) and flash memories; magnetic disks such as fixed and removable disks; other magnetic media including tape; optical media such as Compact Disks (CDs) or Digital Versatile Disks (DVDs). Note that the instructions of the software discussed above can be provided on computer-readable or machine-readable storage medium, or alternatively, can be provided on multiple computer-readable or machine-readable storage media distributed in a large system having possibly plural nodes. Such computer-readable or machine-readable medium or media is (are) considered to be part of an article (or article of manufacture). An article or article of manufacture can refer to a manufactured single component or multiple components.

Blocks and/or methods discussed herein can be executed and/or made by a user, a user agent (including machine learning agents and intelligent user agents), a software application, an electronic device, a computer, firmware, hardware, a process, a computer system, and/or an intelligent personal assistant. Furthermore, blocks and/or methods discussed herein can be executed automatically with or without instruction from a user.

What is claimed is:

1. A method executed by one or more electronic devices that correct errors where a user hears binaural sound, the method comprising:

processing, with a processor, sound with head-related transfer functions (HRTFs) including coordinates ($\theta 1$, $\phi 1$), where $\theta 1$ is an azimuth angle and $\phi 1$ is an elevation angle;

playing, with a wearable electronic device (WED) worn by the user, the binaural sound processed with the HRTFs;

measuring, with head tracking in the WED worn by the user, a head movement represented by coordinates ($\theta 2$, $\phi 2$) when the binaural sound plays to the user to externally localize to a sound localization point (SLP);

calculating, while the user wears the WED, an error of ($|\theta 1-\theta 2|$, $|\phi 1-\phi 2|$) that is a difference between the coordinates ($\theta 1$, $\phi 1$) of the HRTFs that processed the sound and the coordinates ($\theta 2$, $\phi 2$); and correcting, by the WED worn by the user, the error.

2. The method of claim 1 further comprising:

correcting the error by changing, while the user wears the WED, the HRTFs processing the sound in order to reduce the error of ($|\theta 1-\theta 2|$, $|\phi 1-\phi 2|$).

3. The method of claim 1 further comprising:

correcting the error by changing, while the user wears the WED, a location in one of virtual reality (VR) or augmented reality (AR) of an image that represents a source of the binaural sound in order to align the SLP and the location of the image that represents the source of the binaural sound.

4. The method of claim 1 further comprising:

correcting the error by repeatedly changing, while the user wears the WED, the HRTFs processing the sound until HRTF coordinates ($\theta$, $\phi$) equal the coordinates ($\theta 2$, $\phi 2$).

5. The method of claim 1 further comprising:

determining that HRTF coordinates ($\theta$, $\phi$) equal the coordinates ($\theta 2$, $\phi 2$) while a face of the user is toward the SLP where the binaural sound externally localizes to the user; and displaying, to the user, an image that represents the source of the binaural sound at coordinates (θ, ϕ) after and in response to the determining that the coordinates (θ, ϕ) equal the coordinates (θ2, ϕ2) while the face of the user is toward the SLP where the binaural sound externally localizes to the user.

6. The method of claim 1, further comprising:

processing, with the processor, an alert with the HRTFs;

playing, with the WED, the alert processed with the HRTFs before providing the user with the sound processed with the HRTFs;

measuring, with the head tracking, an azimuth angle θ3 while a head of the user points in a direction of an origin of the alert;

calculating an error of (|θ1−θ3|); and changing the HRTFs processing the sound in response to calculating that the error of (|θ1−θ3|) is greater than a threshold value.

7. The method of claim 1, further comprising:

ignoring the error of (|θ1−θ2|, |ϕ1−ϕ2|) and not changing the HRTFs processing the sound when the difference between the coordinates (θ1, ϕ1) and the coordinates (θ2, ϕ2) is less than ten degrees (10°) azimuth.

8. A non-transitory computer-readable storage medium that stores instructions in which one or more electronic devices execute a method that corrects errors where a user hears sound as binaural sound, the method comprising:

processing the sound with head-related transfer functions (HRTFs) having coordinates (θ1, ϕ1), where θ1 is an azimuth angle to a source of the binaural sound, and ϕ1 is an elevation angle to the source of the binaural sound;

playing, with a wearable electronic device (WED) worn by the user, the binaural sound processed with the HRTFs;

measuring, with head tracking in the WED, a change of yaw and a change of pitch in response to the user hearing the binaural sound that causes the user to change a head orientation to a location where the user externally localizes the binaural sound;

calculating an azimuth error of the HRTFs processing the sound by comparing the change of yaw to the azimuth angle of θ1;

calculating an elevation error of the HRTFs processing the sound by comparing the change of pitch to the elevation angle of ϕ1; and correcting the azimuth error and the elevation error by changing the HRTFs processing the sound.

9. The non-transitory computer-readable storage medium of claim 8 further comprising:

correcting the azimuth error only when the azimuth error reaches a predetermined value; and correcting the elevation error only when the elevation error reaches a predetermined value.

10. The non-transitory computer-readable storage medium of claim 8 further comprising:

determining that the head orientation of the user faces different coordinates (θ2, ϕ2) in response to the user hearing the binaural sound; and displaying an image representing the source of the binaural sound at the coordinates (θ2, ϕ2) only after determining that the head orientation of the user faces the coordinates (θ2, ϕ2) in response to the user hearing the binaural sound.

11. The non-transitory computer-readable storage medium of claim 8 further comprising:

selecting different HRTFs based on an anatomy of a different user that is not the user when the azimuth error is greater than a predetermined amount; and processing the sound with the different HRTFs, wherein the azimuth error is an absolute value of a difference in degrees between the azimuth angle of θ1 and the change of yaw when the user changes the head orientation and faces the location where the user externally localizes the binaural sound in response to hearing the binaural sound.

12. The non-transitory computer-readable storage medium of claim 8 further comprising:

selecting different HRTFs based on an anatomy of a different user that is not the user when the elevation error is greater than a predetermined amount; and processing the sound with the different HRTFs, wherein the elevation error is an absolute value of a difference in degrees between the elevation angle of ϕ1 and the change of pitch when the user changes the head orientation and faces the location where the user externally localizes the binaural sound in response to hearing the binaural sound.

13. The non-transitory computer-readable storage medium of claim 8 further comprising:

selecting different HRTFs based on an anatomy of a different user that is not the user when 20°<θ1<60° and the user changes the head orientation in a negative azimuth direction in response to hearing the binaural sound; and processing the sound with the different HRTFs.

14. The non-transitory computer-readable storage medium of claim 8 further comprising:

selecting different HRTFs based on an anatomy of a different user that is not the user when 10°<ϕ1<45° and the user changes the head orientation in a negative elevation direction in response to hearing the binaural sound; and processing the sound with the different HRTFs.

15. A wearable electronic device (WED) that corrects an error where a user hears binaural sound, the WED comprising:

a memory that stores head-related transfer functions (HRTFs);

a digital signal processor (DSP) that processes sound into binaural sound with a pair of the HRTFs having a coordinate location; and head tracking that tracks head movements of the user to determine a coordinate location when the user looks at a location where the binaural sound processed with the pair of the HRTFs externally localizes to the user, wherein the WED determines the error where the user hears the binaural sound by comparing the coordinate location when the user looks at the location where the binaural sound processed with the pair of the HRTFs externally localizes to the user to the coordinate location of the pair of the HRTFs, and the WED corrects the error where the user hears the binaural sound.

16. The WED of claim 15, wherein the WED corrects the error by selecting a different pair of the HRTFs to process the sound while the user looks at the location when a difference between the coordinate location when the user looks at the location where the binaural sound processed with the pair of the HRTFs externally localizes to the user and the coordinate location of the pair of the HRTFs is greater than ten degrees (10°) azimuth, and wherein the WED ignores the error when the difference between the coordinate location when the user looks at the location where the binaural sound processed with the pair of the HRTFs externally localizes to the user and the coordinate location of the pair of the HRTFs is less than the ten degrees (10°) azimuth.

17. The WED of claim 15, wherein the WED repeatedly determines a difference between the coordinate location when the user looks at the location where the binaural sound processed with the pair of the HRTFs externally localizes to the user and the coordinate location of the pair of the HRTFs until the difference is less than ten degrees (10°) azimuth.

18. The WED of claim 15 further comprising:

a display that displays an image at the location where the binaural sound processed with the pair of the HRTFs externally localizes to the user after and in response to determining that the error where the user hears the binaural sound is below the predetermined value.

19. The WED of claim 15, wherein the sound is a ringtone indicating an incoming telephone call to the user, and the WED determines the error where the user hears the binaural sound before the user answers the incoming telephone call.

20. The WED of claim 15, wherein the WED reduces the error by changing the pair of the HRTFs processing the sound while the user looks at the location by selecting a different pair of the HRTFs based on a user having different physical attributes than the user when a head orientation of the user changes more than a threshold amount in response to hearing the sound processed with the pair of the HRTFs.

* * * * *